United States Patent [19]

Yamazaki

[11] Patent Number: 4,896,007

[45] Date of Patent: Jan. 23, 1990

[54] SWITCHING APPARATUS WITH AN ELECTRICALLY CONDUCTIVE OPERATING BAR

[75] Inventor: Hiroshi Yamazaki, Yokohama, Japan

[73] Assignee: Ohi Seisahisho, Co., Ltd., Kanagawa, Japan

[21] Appl. No.: 227,257

[22] Filed: Aug. 2, 1988

[30] Foreign Application Priority Data

Sep. 22, 1987 [JP] Japan ..... 62-143799[U]

[51] Int. Cl.[4] ..... H01H 9/06

[52] U.S. Cl. ..... 200/61.87; 340/457.3

[58] Field of Search ..... 200/61.62, 61.85, 61.87, 200/61.89, 61.67, 61.7, 61.63, 61.64, 61.65, 61.66, 61.68, 61.69, 61.72, 61.73, 61.74, 61.75, 61.76, 61.77, 61.78, 61.79, 61.80, 61.81, 61.82, 61.83, 61.84; 340/457.3

[56] References Cited

U.S. PATENT DOCUMENTS 1,399,170 12/1921 Vandevelde ..... 200/61.68

4,616,112 10/1986 Galloway et al. ..... 200/16 D

FOREIGN PATENT DOCUMENTS 582893 12/1946 United Kingdom .

934399 8/1963 United Kingdom .

*Primary Examiner*—A. D. Pellinen

*Assistant Examiner*—Morris Ginsburg

*Attorney, Agent, or Firm*—Helfgott & Karas

[57] ABSTRACT

In a combination of a switching apparatus with a pivotable actuating lever, the apparatus includes an electrically conductive base having two opposing rising walls and an electrically conductive operating bar supported slidably between the rising walls of the base. The bar has a laterally projecting portion. A terminal is fixed to one of the rising walls of the base by an insulator. A spring wound about the bar causes an end of the operating bar to project outwardly from one of the rising walls and biases the operating bar in a direction, in which the lateral projecting portion of the operating bar contacts the terminal.

5 Claims, 3 Drawing Sheets

SWITCHING APPARATUS WITH AN ELECTRICALLY CONDUCTIVE OPERATING BAR

The present invention relates to a switching apparatus suitably used for flickering a parking brake lamp, etc. for a vehicle.

BACKGROUND OF THE INVENTION

FIGS. 1 and 2 show a conventional switch used to flicker a parking brake lamp for a vehicle.

In such a switch, an operating bar 3 made of hard resin is slidably supported by leg portions 2A and 2B of a support member 2 having a U-shape in cross section and fixed to an electrically conductive base 1 for supporting a parking brake lever as an earth. As shown in FIG. 2, a head portion 3A of the operating bar 3 is widened, and a compression spring 4 is disposed between a step portion 3B and the leg portion 2B of the support member 2 to bias the head portion 3A such that the head portion 3A is projected from the leg portion 2A. An electrically conductive terminal member 5 is composed of a contact portion 5A having a U-shape in cross section and a connecting terminal portion 5B extending from the contact portion 5A, and is attached by fastener 6 to an end portion of the operating bar 3. Both leg pieces of the contact portion 5A contact an outer face of the leg portion 2B of the support member 2 by the biasing force of the compression spring 4, and the connecting terminal portion 5B is connected to a lead wire 7.

In the switch mentioned above, the head portion 3A of the operating bar 3 is pressed by the parking brake lever during the running of the vehicle, and the contact portion 5A is separated from the support member 2 against the biasing force of the compression spring 4 so that the switch is not turned on.

When the parking brake lever is pulled up to actuate a side brake the pressing force applied to the head portion 3A of the operating bar 3 is released, and the contact portion 5A contacts the support member 2 by the compression spring 4, so that the switch is turned on and the parking brake lamp is thereby turned on.

However, in such a conventional switch, since the terminal member 5 connected to the lead wire is moved every switching operation, the lead wire is also oscillated so that it is possible to disconnect the lead wire 7 by the repetition of the switching operation.

To overcome the problems mentioned above, an object of the present invention is to provide a switching apparatus in which a lead wire is not disconnected by the repetition of the switching operation and the switch is cheaply manufactured.

With the above object in mind, the present invention resides in a switching apparatus comprising an electrically conductive base means having rising walls; an electrically conductive operating bar means slidably supported by the rising walls of the base means and having a projecting portion in a trunk portion thereof; terminal means fixed to one of the rising walls of the base means through an insulator; and resilient means projecting an end of the operating bar means from one of the rising walls and biasing the operating bar in a direction in which the projecting portion of the operating bar means contacts the terminal means.

BRIEF DESCRIPTION OF THE DRAWINGS

The present invention will be more apparent from the following description of the preferred embodiments thereof in conjunction with the accompanying drawings in which.

DETAILED DESCRIPTION OF THE PREFERRED EMBODIMENTS

The preferred embodiments of the present invention will now be described with reference to the accompanying drawings.

Figure 1:
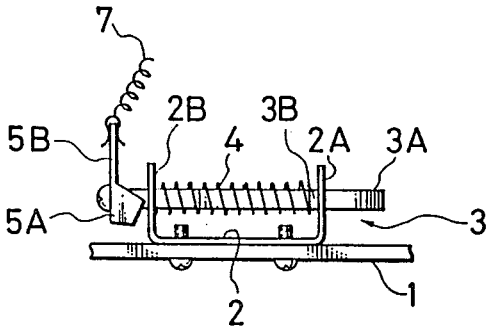
FIG. 1 PRIOR ART
FIG. 1 a side view of a conventional switch.
Figure 2:
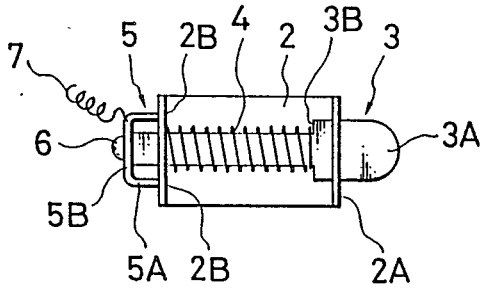
FIG. 2 PRIOR ART
FIG. 2 is a plan view of the conventional switch.
Figure 3:
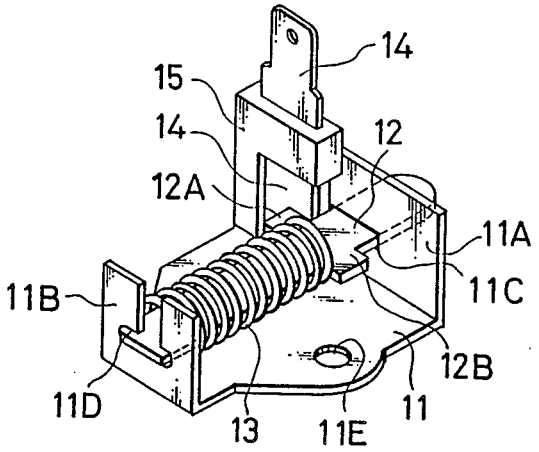
FIG. 3 is a perspective view of a switching apparatus in accordance with an embodiment of the present invention.

FIG. 3 shows a perspective view of a switching apparatus in accordance with one embodiment of the present invention.

In FIG. 3, a base plate 11 has rising walls 11A and 11B on both sides thereof, and is made of an electrically conductive material such as iron. Guide holes 11C and 11D are disposed in opposite positions of the rising walls 11A and 11B. Holes 11E and 11F for attachment are disposed in a central portion of the base plate 11.

Figure 4:
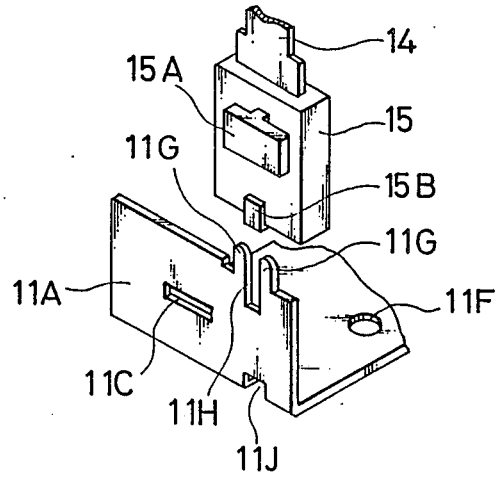
FIG. 4 is a perspective rear view of the switching apparatus.

As shown in FIG. 4, two parallel projecting pieces 11G, a notch groove 11H and an engaging hole 11J are disposed in one of the rising walls 11A. The two parallel projecting pieces 11G project from an upper end edge of the rising wall 11A, ad the notch groove 11H. is disposed between the parallel projecting pieces 11G, and the engaging hole 11J is disposed just below the notch groove 11H in an end edge portion of the rising wall 11A.

An operating bar 12 is slidably supported by the guide holes 11C and 11D of the rising walls 11A and 11B, and is made of an electrically conductive material such as iron, and has projecting pieces 12A and 12B on both sides thereof. The projecting piece 12A has a trapezoidal shape in a portion thereof in contact with a terminal 14 described later to form a sharpened portion therein, and the projecting piece 12B simply has a rectangular shape.

A compression spring 13 is disposed between the projecting pieces 12A, 12B and the rising wall 11B, and is wound around the operating bar 12. The projecting piece 12A of the operating bar 12 contacts the terminal 14, and the compression spring 13 biases the operating bar 12 in a direction in which an end of the operating bar 12 is projected from the rising wall 11A.

The terminal 14 is integrally molded with a seal bracket 15 approximately having a rectangular parallellopiped shape and made of resin. As shown in FIG. 4, an attaching piece 15A having a T-shape in cross section is disposed in an upper rear central portion of the seal bracket 15, and a rectangular engaging piece 15B is disposed in a lower portion of the seal bracket 15 and is integrally formed with the attaching piece 15A.

The seal bracket 15 surrounding the terminal 14 has a portion to which the terminal 14 is exposed, and a root portion of the attaching piece 15A disposed on the rear face of the seal bracket 15 is inserted into the notch groove 11H of the rising wall 11A, and is guided downwards and is further inserted. Thereafter, the engaging piece 15B is click-engaged with the engaging hole 11J of the rising wall 11A, and thereafter, the upper end portion of the parallel projecting pieces 11G is deformed inwards by caulking, thereby fixing the seal bracket 15 to the base plate 11.

Figure 5:
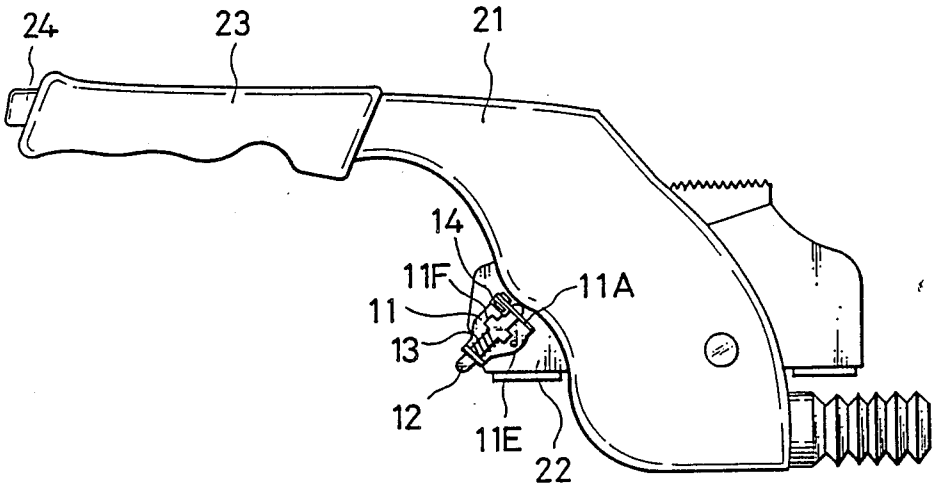
FIG. 5 is a side view of the switching apparatus used as a parking brake switch.

The switch constructed as above can be used as a parking brake switch, for example, as shown in FIG. 5.

In this case, the base plate 11 of the switch is fixed by an unillustrated fastener, etc. to an electrically conductive base 22 for rotatably supporting the parking brake lever 21 through holes 11E and 11F for attachment. Then, an end of the operating bar 12 is pressed by this lever 21 in a releasing state of the parking brake lever 21, and the switch is not turned on. The terminal 14 is connected to a lead wire.

When a driver grips a grip .23 and rotates the parking brake lever 21 by the grip 23, the pressing action onto the end portion of the operating bar 12 is released by the lever 21 so that the operating bar 12 is moved by the biasing force of the compression spring 13 and the projecting piece 12A contacts the terminal 14.

Accordingly, the terminal 14 is electrically conducted to the base 22 as an earth through the electrically conductive operating bar 12 and base plate 11, turning on the parking lamp.

In this embodiment, the sharpened portion of the projecting piece 12A contacts the terminal 14, and is pressed by the compression spring 13 so that the contact is stably performed and the incomplete contact due to dust, waste, etc. is prevented.

In contrast, when the releasing operation of the parking brake lever 21 is performed by pushing the button 24, the end portion of the operating bar 12 is pressed and the switch is turned off and the parking lamp is thereby turned off.

Accordingly even when the switching operation is repeated, the terminal 14 is fixed to the rising wall 11A of the base plate 11 and is thereby not moved, and the lead wire is also fixed, preventing the damage of the lead wire.

Further, in the present invention, since the operating bar is constructed by an electrically conductive material such as iron which is cheap, providing a cheap switch.

In addition, the parking brake lever switch is used in the above embodiment, but the present invention is not limited to such a switch. For example, the present invention can be also applied to a brake pedal switch, an axle pedal switch, etc. having a construction similar to the construction of the switch mentioned above.

As mentioned above, in accordance with the present invention, the electrically conductive operating bar is slidably supported by rising walls on both sides of the base plate made of an electrically conductive material. The terminal is fixed to one of the rising walls of the base plate through an insulator, and projecting pieces disposed in a trunk portion of the operating bar come in contact with this terminal. The operating bar is biased by a resilient body in a direction in which an end of the operating bar is projected from one of the rising walls.

When the end of the operating bar is pressed, the operating bar is slided against the biasing force of the resilient body so that the projecting piece of the operating bar is separated from the terminal, turning the switch off.

When the pressing force is released, the operating bar is slided by the biasing force such that the projecting piece contacts the terminal, flowing an electric current through the base plate, the operating bar and the terminal.

Accordingly, the switching operation is performed without moving the terminal so that a lead wire connected to the terminal is not damaged and the switch is cheaply manufactured.

What is claimed is:

1. In a combination of a switching apparatus with a rotatable actuating lever, the apparatus comprising:

electrically conductive base means including opposing rising walls having slots opposing each other;

electrically conductive operating bar means extending through said slots of said rising walls and being slidably supported by the rising walls, said operating bar means having a laterally projecting portion;

seal bracket means made of resin and forming an electrical insulator and attached to one of the rising walls of the base means;

terminal means integrally formed with the seal bracket means and fixed to said one of the rising walls of the base means by said seal bracket means;

said operating bar means having an end portion; and spring means disposed around said operating bar means between said rising walls and being engaged with said laterally projecting portion to cause said end portion of the operating bar means to project outside of said one of the rising walls to cooperate with said lever, said spring means biasing the operating bar means so that said laterally projecting portion of the operating bar means comes into contact with the terminal means, whereby, upon rotation of said lever by an external force, said lever acts on said end portion so as to selectively hold said operating bar means in a pressed position, in which said laterally projecting portion is prevented from contact with said terminal means, and a released position, in which said laterally projecting portion comes into and remains in contact with said terminal means.

2. The combination as claimed in claim 1, wherein the base means comprises a base plate having said rising walls on both sides thereof.

3. The combination as claimed in claim 1, wherein the spring means comprises a compression spring.

4. The combination as claimed in claim 1, wherein the terminal means is integrally molded with the seal bracket means.

5. The combination as claimed in claim 4, wherein the seal bracket means has an attaching piece for attaching the terminal means to the base means.

* * * * *